United States Patent [19]

Perry

[11] Patent Number: 4,894,939

[45] Date of Patent: Jan. 23, 1990

[54] SAFETY FOR FIRE ARMS

[76] Inventor: Wayne R. Perry, 41333 London Dr., Parker, Colo. 80134

[21] Appl. No.: 264,456

[22] Filed: Oct. 31, 1988

[51] Int. Cl.[4] ..... F41C 17/08

[52] U.S. Cl. ..... 42/66; 42/70.08

[58] Field of Search ..... 42/66, 70.08

[56] References Cited

U.S. PATENT DOCUMENTS

| | | | |
|---|---|---|---|
| 573,736 | 12/1896 | Wesson | 42/66 |
| 635,705 | 10/1899 | Wesson | 42/66 |
| 792,381 | 6/1905 | Allen | 42/66 |
| 2,654,174 | 10/1953 | Hansen | 42/66 |
| 3,422,559 | 1/1969 | Woloch | 42/66 |
| 3,978,603 | 9/1976 | Murabito | 42/66 |
| 3,988,847 | 11/1976 | Kennedy | 42/66 |
| 4,091,557 | 5/1978 | Murabito | 42/66 |
| 4,439,942 | 4/1984 | MaGabilondo | 42/66 |
| 4,769,936 | 9/1988 | Miller | 42/66 |
| 4,771,561 | 9/1988 | Waiser | 42/66 |
| 4,791,747 | 12/1988 | Pastor | 42/66 |

*Primary Examiner*—Deborah L. Kyle

*Assistant Examiner*—Michael J. Carone

*Attorney, Agent, or Firm*—John E. Reilly

[57] ABSTRACT

A revolver has a cylinder mounted so that actuation of the hammer will cause the hammer to strike one end of a cartridge in a chamber of the cylinder. The cylinder is mounted for rotation about a center pin, and a bolt having a projection at one end is aligned with the center pin to release it for lateral swinging movement of the cylinder away from the recess. A first spring member is associated with the center pin for urging it rearwardly, and the bolt has an abutment slidable into and out of the path of pivotal movement of the hammer. The revolver is modified by a second spring member associated with the abutment which overcomes the first spring member to urge the abutment into a position in the path of the hammer. A manually engageable slide is engageable with the bolt and movable in a first direction causing the projection to engage the center pin to release it from the frame and further movable in a second direction causing the abutment to slide out of the path of pivotal movement of the hammer.

6 Claims, 2 Drawing Sheets

SAFETY FOR FIRE ARMS

This invention relates to firearms; and more particularly relates to a novel and improved safety for revolvers, particularly the Smith & Wesson 38 and 357 revolvers.

BACKGROUND AND FIELD OF THE INVENTION

Revolvers are customarily made to include a main frame or body portion, a handle or gripping portion at one end of the body portion, and a barrel with a rotatable cartridge cylinder mounted on the body. The body portion includes a trigger guard and trigger with a hammer which is pivotally mounted on the body above the handle portion and rearwardly of the cylinder. The hammer can be pivoted independently or in response to pulling the trigger so as to be forced rearwardly against the urging of a main spring until it moves past the center at which point it is driven forwardly to discharge or fire the weapon.

Safeties have been devised in the past for the purpose of preventing accidental discharge of firearms. Typically, safeties that have been designed for use with revolvers have required addition of parts or redesign of the weapon itself. Representative of said safeties are those disclosed in U.S. Pat. Nos. 573,736 to Wesson et al, 635,705 to Wesson et al, 3,422,559 to Wolloch, 792,381 to Allen, 3,978,603 and 4,091,557 to Murabito. The early patents to Allen and Wolloch may be generally characterized as providing some form of a spring-loaded plunger having a safety which will normally interfere with hammer movement until the plunger is selectively released by the thumb. In Wesson et al '736, the safety is activated only when the plunger is advanced manually to release the cylinder for reloading or cleaning. In the '603 patent to Murabito a thumbpiece engages a specially formed shoulder in a slotted portion or recess so as to override the stronger force of a compression spring. Similarly, in the more recent '557 patent to Murabito, a special safety device is added to a Ruger doubleaction revolver.

The Smith & Wesson revolvers, such as, the Model 10 Combat Magnum manufactured and sold by Smith & Wesson of Springfield, Mass., employ a thumbpiece on one side of the handle which serves as a release for the cylinder in order to permit loading of the cylinder with cartridges or bullets. In this relation, a bolt on the Smith & Wesson includes a nose which engages a center pin on the cylinder, and a thumbpiece must be positively advanced against the urging of a spring on the center pin in order to cause retraction of the center pin and release of the cylinder for loading. At the same time, the bolt is normally biased or urged in a direction so as to be clear of the path of the hammer. To my knowledge, however, no one has successfully devised a safety for the Smith & Wesson revolver in which the spring members acting in opposition to one another at opposite ends of the bolt are so designed that the relative spring force is balanced in such a way as to normally position an abutment on the bolt in the path of movement of the hammer so that the weapon can be fired only by a positive manual release or movement of the abutment out of the path of the hammer. It is therefore proposed in accordance with the present invention to devise a method and means for retrofitting weapons of this type such that they will be equipped with safeties but without requiring redesign or fabrication of the weapon itself, or the addition of special parts; yet to be able to incorporate into existing weapons a safety which both can be effectively disguised and will normally remain in a safety position until positively released.

SUMMARY OF THE INVENTION

It is therefore an object of the present invention to provide for a novel and improved safety for firearms and specifically wherein the safety can be retrofit into existing weapons without the addition of new of different parts, or reconstruction of the weapon itself.

Another object of the present invention is to provide for a novel and improved safety for firearms and in particular revolvers which can be effectively disguised as a part of the existing weapon and must be positively released in order to fire the weapon.

It is an additional object of the present invention to provide for a novel and improved safety for Smith & Wesson revolvers which can be incorporated into the existing bolt of the weapon without altering its normal functioning and operation.

It is a still further object of the present invention to provide for a novel and improved method and means for modifying the existing center pin release of a revolver in such a way as to act both as a safety and as a center pin release and which is greatly simplified in construction and dependable in use.

In accordance with the present invention, a standard revolver frame includes a hammer pivotal at one end of the frame, a barrel, a trigger to actuate the hammer, a cylinder mounted in a recess in the frame such that actuation of the hammer will cause the hammer to strike one end of a cartridge in a chamber of the cylinder. The cylinder is mounted for rotation about a center pin, the center pin normally urged in an axial direction into an opening in the frame, and a bolt having a projection at one end is aligned with the opening for engagement with the center pin to release the center pin from the frame for lateral swinging movement of the cylinder and the center pin away from the recess. A first spring member is associated with the center pin for urging the center pin rearwardly into the opening in the frame, the bolt plunger having an abutment at one end slidable into and out of the path of pivotal movement of the hammer, and a second spring member is associated with the abutment for urging the abutment into a position in the path of the hammer, the spring force of the second spring member overcoming the urging of the first spring member to normally position the abutment in the path of movement of the hammer. Slide means are movable through a slot in the frame and engageable with the bolt plunger and movable in a first direction causing the projection to engage the center pin to release the center pin from the frame and further moveable in a second direction causing the abutment to slide out of the path of pivotal movement of the hammer.

The above and other objects, advantages and features of the present invention will become more readily understood and appreciated from a consideration of the following detailed description of a preferred embodiment thereof when taken together with the accompanying drawings, in which:

DETAILED DESCRIPTION OF THE PREFERRED EMBODIMENT

Figure 1:
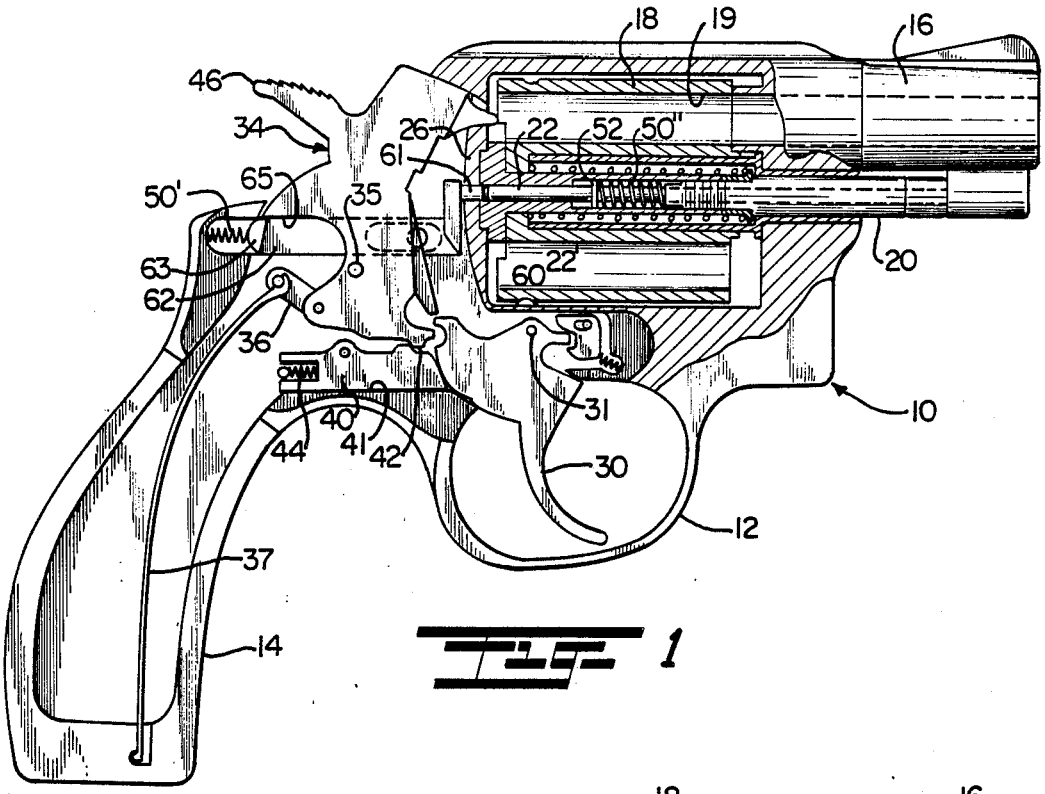
FIG. 1 is a side view partially in section and with the side plate removed to illustrate the modifications made in a preferred form of weapon in accordance wih the present invention.
Figure 2:
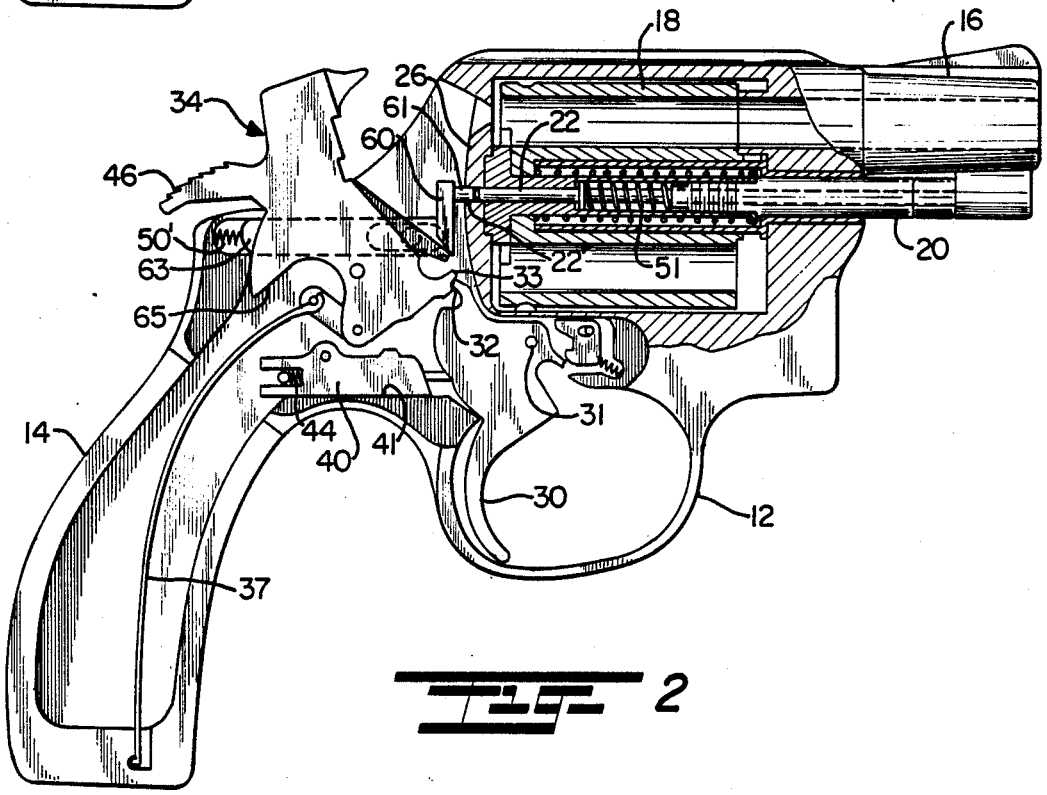
FIG. 2 is a view similar to FIG. 1 but illustrating the hammer in a cocked position.

Referring in detail to the drawings, there is shown by way of illustrative example in FIGS. 1 to 4 a conventional form of Smith & Wesson revolver; namely, a Model 10 Combat Magnum which has been modified to incorporate a safety device therein in accordance with the present invention. As a setting for the present invention, the revolver as shown is broadly comprised of a body or frame 10, a trigger guard 12 and handle portion 14. A barrel 16 is positioned as a forward extension of the body 10, and a cylinder 18 is mounted for rotation on an extractor rod 20, the rod 20 having a center pin 22 extending through a central bore 24 in the cylinder 18. It will be noted that the center pin 22 is movable axially between a position retracted within the cylinder 18 and short of stationary end cap 26 at the upper rearward end of the body and an extended position, as shown in FIG. 2, advancing into an opening or bore 27 in the end cap 26 so as to effectively lock the cylinder against pivotal or swinging movement away from the body 10. In other words, the cylinder 18 is normally in a firing position as shown with successive chambers 19 of the cylinder movable into alignment with the barrel 16 for firing; however, when the center pin 22 is retracted within the cylinder 18, the cylinder 18 can be swung outwardly to expose the chambers 19 for reloading.

The trigger 30 is pivotal about an upper pivot 31 with a rearwardly directed lever end 32 engageable with a projection 33 at the lower end of hammer 34. The hammer 34 is pivotal about a lower pivot 35 and includes a lever arm 46 and a link member 36 which engages the upper end of a main spring 37, the latter extending downwardly through a cavity 38 in the handle portion 14. A rebound slide member 40 is disposed on a guide surface 41 and has an upward projection 42 engageable by the projection 33 on the hammer when the hammer is in the forward position, as shown in FIG. 1. When the trigger 30 is pulled or pivoted rearwardly, it will cause the slide 40 to move rearwardly along the surface 41 against the urging of a return spring 44. Simultaneously, the projection 32 will cause the hammer 34 to be pivoted in a rearward direction, as illustrated in FIG. 2, against the urging of the main spring 37. At the end of travel of the trigger 30, the lever 32 will have cleared the hammer 34, and the main spring 37 will drive the hammer forwardly until its nose 34' strikes the end of a bullet or cartridge in one of the chambers 19 of the cylinder. When the trigger 30 is released, the slide 40 will act under the urging of the return spring 44 to force the trigger 30 back to its original position as shown in FIG. 1.

Figure 3:
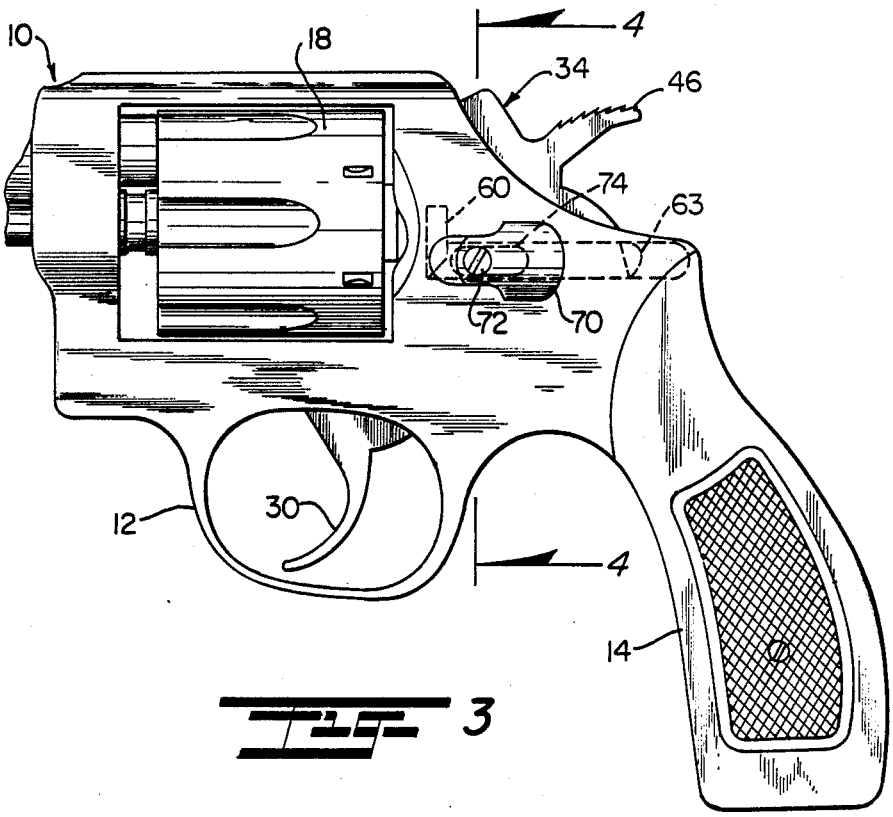
FIG. 3 is a side view in elevation of an opposite side of the weapon as shown in FIGS. 1 and 2.
Figure 4:
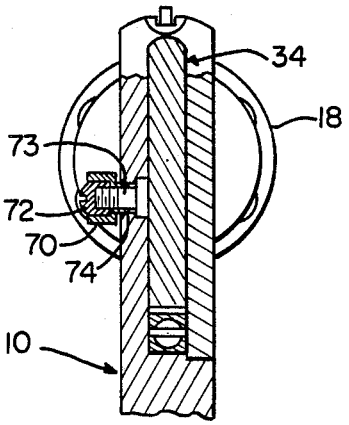
FIG. 4 is a cross-sectional view taken about lines 4—4 of FIG. 3.
Figure 5:
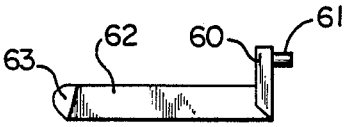
FIG. 5 is a perspective view illustrating the bolt member forming a part of a standard revolver.

An end plate 60 including a forward projection 61 is disposed at the forward end of a bolt 62 which is slidable through an internal channel or recess in the frame alongside the hammer 34 and directly above the pivot 35 of the hammer. The bolt 62 includes a transversely extending shoulder or abutment 63 at its rearward end which is slidable into and out of the pivotal path of movement of the hammer 34 and specifically the shoulder surface 65 on the hammer. Accordingly, when the abutment 63 is urged forwardly into the path of movement of the should 65, it will prevent firing of the weapon. A thumbpiece 70 is provided with a locking screw 72 for connection to stud 73 which projects laterally away from the bolt 60 through an elongated slot 74 in the frame, as shown in FIGS. 3 and 4. The center pin 22 of the standard Smith & Wesson revolver is normally urged rearwardly toward the end cap 26 by a coiled spring member, not shown, which is of a length and has a spring constant causing the center pin 22 to force the bolt 60 rearwardly a distance such that the abutment 63 is disposed rearwardly out of the path of the shoulder 65 on the hammer 34. As a result, the thumbpiece 70 must be manually engaged to slide forwardly through the slot and overcome the force of that spring in order to advance the center pin 22 forwardly out of the end cap 26 and release the cylinder 18 from the frame. In advancing the bolt 62 forwardly, the abutment 63 will then move into the path of the hammer so as to prevent accidental pivoting of the hammer 34 downwardly when the cylinder is being reloaded or cleaned.

An important feature of the present invention is to assure that the gun is normally in a safety position and cannot be fired until the safety is positively released. Equally important is to attain this objective without redesign or special fabrication of parts so that existing revolvers as described can be easily modified by the owner to remain in a safety position until positively released for firing. To this end, as illustrated in FIG. 7, the existing center pin spring of the standard revolver as described is cut or divided into two segments 50' and 50''. The shorter segment 50' is positioned behind the abutment 63, leaving the longer segment 50'' in position on the center pin 22. The segment 50' is of a length and spring constant sufficient to urge the abutment 63 forwardly, as illustrated in FIG. 1, into the path of the shoulder 65 of the hammer but not to advance the end 22' of the center pin so far that is will move out of engagement with the end cap 26. Thus, the thumbpiece 70 will remain centered, or slightly forward of center, with respect to the slot 74 but require forwared advancement through the end of the slot 74 in order to release the center pin 22. Conversely, in order to release the safety and permit the gun to be fired, it is necessary for the operator to manually engage the thumbpiece 70 and retract it rearwardly through the slot 74 until the abutment 63 is retracted and clears the path of the hammer 34.

For the purpose of illustration but not limitation, in a Model 10 Combat Magnum the spring segment 50'' is shortened to a length of 20 mm.±2 mm., and the segment 50' is on the order of 5 mm.±1 mm. The segment 50'' is positioned within a sleeve 51 and in surrounding relation to the center pin 22 in a well known manner between a collar 52 and the end of the extractor rod 20. In this way, the spring segments 50' and 50'' will act in opposition to one another at opposite ends of the bolt plunger, the spring force of the segment 50' overcoming the urging of the segment 50'' to normally position the abutment 63 in the path of movement of the hammer. It will be evident that the same result may be accomplished by substituting spring elements of the desired spring constants and lengths to establish the desired net biasing force or pressure on the abutment 63 causing it to be stationed in a normal safety position as described. Nevertheless, division of the existing spring into two segments 50' and 50'' as described represents the most simple expedient for devising a safety and which can be done without fabrication or addition of new parts. The spring segment 50' is employed behind the abutment 63 irrespective of the use of a bolt plunger and spring, not shown, which are customarily positioned in the abutment of the Smith & Wesson revolvers.

It is therefore to be understood that while a preferred form of invention has been set forth and described herein that the principles of the present invention have useful application for other firearms where it is desired to provide a safety as described, and that various modifications and changes may be made in the construction and arrangement of parts without departing from the spirit and scope of the present invention as defined by the appended claims.

I claim:

1. In a revolver wherein a frame includes a hammer pivotal at one end of said frame, a barrel, a trigger to actuate said hammer, a cylinder mounted in a recess in said frame such that actuation of said hammer will cause said hammer to strike one end of a cartridge in a chamber of said cylinder, said cylinder mounted for rotation about a center pin, said center pin normally urged in an axial direction into an opening in said frame, and a bolt having a projection at one end aligned with said opening for engagement with said center pin, said bolt having an abutment at one end slidable into and out of the path of pivotal movement of said hammer, the improvement comprising:

a first spring member associated with said center pin for urging said center pin rearwardly into the opening in said frame;

a second spring member associated with said abutment for urging said abutment into a position in the path of said hammer, said first and second spring members acting in opposition to one another, the spring force of said second spring member being sufficient to overcome the urging of said first spring member to normally position said abutment in the path of movement of said hammer; and manually engageable slide means movable with said bolt and movable through a slot in said frame in a first direction causing said projection to engage said center pin to release said center pin from said frame and further moveable in a second direction causing said abutment to slide out of the path of pivotal movement of said hammer.

2. In a revolver according to claim 1, said manually engageable slide means being in the form of a thumbpiece, and said slot being elongated in a direction parallel to the direction of movement of said abutment into and out of the path of pivotal movement of said hammer.

3. In a revolver wherein a frame includes a hammer pivotal at one end of said frame, a barrel, a trigger to actuate said hammer, a cylinder mounted in a recess in said frame whereby actuation of said hammer will cause said hammer to strike one end of a cartridge in a chamber of said cylinder, said cylinder mounted for rotation about a center pin, said center pin normally urged in an axial direction into an opening in said frame, and a bolt having a projection at one end aligned with said opening for engagement with said center pin to release said center pin from said frame for lateral swinging movement of said cylinder and said center pin away from said recess into a position in which said cylinder can be reloaded, the improvement comprising:

said bolt having an abutment at one end slidable into and out of the path of pivotal movement of said hammer;

a spring member associated with said center pin for urging said center pin rearwardly into the opening in said frame;

a second spring member associated with said abutment for urging said abutment into a position in the path of said hammer; and manually engageable slide means engageable with said bolt and movable in a first direction causing said projection to engage said center pin to release said center pin from said frame and further moveable in a second direction causing said abutment to slide out of the path of pivotal movement of said hammer, said first and second spring members acting in opposition to one another at opposite ends of said bolt, the spring force of said second spring member being sufficient to overcome the urging of said first spring member to normally position said abutment in the path of movement of said hammer.

4. In a revolver according to claim 3, said manually engageable slide means being in the form of a thumbpiece movable through a slot in said frame, and said slot being elongated in a direction parallel to the direction of movement of said abutment into and out of the path of pivotal movement of said hammer.

5. In a revolver according to claim 3, said thumbpiece mounted on a side of said frame to be engageable by the thumb of the operator in the course of firing the weapon.

6. The method of providing a safety in a Smith & Wesson revolver, said revolver having a hammer pivotal at one end of a frame, a cylinder mounted in a recess in the frame such that actuation of the hammer will cause the hammer to strike one end of a cartridge in a chamber of the cylinder, the cylinder mounted for rotation about a center pin, and a bolt having a projection at one end aligned with an opening in said frame for engagement with the center pin and an abutment at the opposite end of the bolt slidable into and out of the path of pivotal movement of the hammer, there being a first spring member associated with the center pin for urging the pin in a direction to bear against the projection on the bolt member and force the abutment on the bolt into a position out of the path of travel of the hammer, comprising the steps of providing a second spring member acting at the opposite end of said bolt, the spring force of said second spring member overcoming the force of said first spring member so as to normally position the abutment on said bolt in the path of movement of the hammer.

* * * * *